United States Patent [19]

Blackburn et al.

[11] Patent Number: 4,829,280

[45] Date of Patent: May 9, 1989

[54] THERMAL CONTROL UNITS

[75] Inventors: Arthur M. Blackburn; Robert A. O'Neill; Terence J. C. Foster; Ian G. White, all of Buxton, England

[73] Assignee: Otter Controls Limited, Buxton, England

[21] Appl. No.: 78,506

[22] Filed: Jul. 28, 1987

[30] Foreign Application Priority Data

Jul. 28, 1986 [GB] United Kingdom ..... 8618372

[51] Int. Cl.[4] ..... H01H 37/02

[52] U.S. Cl. ..... 337/299; 337/3; 337/354; 337/365

[58] Field of Search ..... 337/354, 365, 372, 379, 337/380, 113, 91, 3, 299

[56] References Cited

U.S. PATENT DOCUMENTS 4,295,114 10/1981 Pohl ..... 337/3

4,472,705 9/1984 Carlson ..... 337/299

*Primary Examiner*—H. Broome

*Attorney, Agent, or Firm*—Pollock, Vande Sande & Priddy

[57] ABSTRACT

An element protector control for protecting the electrically powered heating element of a kettle against overheating has primary and secondary (or back-up) modes of operation. The primary protection mode utilizes a dished, snap-acting bimetal which is oriented so that the side of the bimetal which is convex when the blade is cold faces the heating element head, and the bimetal is sprung against a flat rear surface of the element head so that the bimetal in its cold condition flattens against the element head. The bimetal determines the condition of a pair of switching contacts provided in the control. The bimetal is mounted in a carrier which is spring biassed towards the element head and, for providing the secondary protection mode, the carrier is formed of a thermoplastics material so that in the event of failure of the primary protection in an overtemperature situation so that the element temperature continues to rise, the carrier will collapse towards the element head, and the collapse of the carrier is arranged to disconnect the control from its power supply terminals.

32 Claims, 4 Drawing Sheets

THERMAL CONTROL UNITS

FIELD OF THE INVENTION

This invention concerns improvements relating to thermal control units and more particularly, though not exclusively, relates to thermal control units for electric immersion heaters for liquid heating vessels such as kettles, jugs, urns, pans and the like. The invention is especially applicable to protective control devices for use with electrically heated water boiling vessels for interrupting the power supply to the heating element in the event of an element over-temperature condition such as might occur for example if the vessel were to be switched on without there being sufficient water in it or if the vessel were to boil dry.

BACKGROUND OF THE INVENTION

One such thermal control unit known from British Patent Specification No. GB-A No. 1401954, is adapted to be secured to the head of an electric heating element of an immersion heater, such head itself being adapted to be mounted in or adjacent an aperture in the wall of a vessel to be fitted with such heating element. The control unit has terminals for electrical connection to the cold tails of the heating element and further incorporates a thermally-sensitive electric switch including a bimetallic snap-acting switch-actuating member positioned so as in use of the control unit to be in good thermal contact with the element head, the bimetallic switch-actuating member being of a type comprising a stressed piece of bimetallic material which moves with changes in temperature between two oppositely dished configurations with a snap action and being mounted so as in its cold condition to present its concave face to the heating element which is formed with a complementarily shaped projection engaging the bimetallic member in supposedly good thermal contact. As is well known, the principal purpose of the thermal control unit is to protect the heating element of the immersion heater by automatically cutting off or reducing the electric power supply to the heating element if it overheats, for example in the case of the vessel boiling dry or being switched on when empty.

While the thermal control unit of GB-A No. 1401954 has been widely and successfully marketed, nonetheless it has given rise to a number of problems. Firstly, it has been found difficult to consistently maintain the positional relationship between the bimetallic element and the complementarily shaped projection on the element head, inter alia because of manufacturing difficulties encountered with the element head and an encountered tendency for the element head to distort. As will be appreciated by those skilled in the art, the dimensional integrity of bimetallic elements of the snap-acting type disclosed in GB-A No. 1401954 is essential to the element demonstrating consistent switch-actuating operation within defined temperature limits, and any tendency of the element head to distort can, with the arrangement of GB-A No. 1401954, lead to bending of the central tongue of the bimetallic blade with consequent variation in the switching characteristics of the blade.

A further difficulty which has been encountered stems from the formation of the element head projection by a stamping process which leaves a corresponding depression on the heating element side of the head. To secure efficient thermal transfer between the element proper and the head, it then proved necessary to enter the heating element into this depression and to braze it to the head with silver solder which not only is expensive, but also has been found to tend to transmit the heat of the element excessively towards the periphery of the immersion heater head with consequent risk of overheating of adjacent plastic material as, for example, when the immersion heater is used with a plastic bodied vessel and/or is secured to a vessel by means of a plastic locking ring.

Other problems with the arrangement of GB-A No. 1401954 and with othre similar arrangements stem from the fact that, as the bimetallic blade begins to move towards its intermediate unstable condition prior to snapping to its alternative configuration, it moves out of thermal contact with the element head and thus a silicone oil based heatsink compound must to be employed, with attendant manufacturing and other disadvantages.

The abovementioned problems are also encountered in the element protection unit, which is the subject of British Patent Specification GB-B No. 2117568 (Otter Controls Ltd) and corresponding U.S. Pat. No. 4,539,468 and which pioneered the concept of providing two independently operating snap-acting bimetallic thermal sensors in such a unit, and with the two independent sensors in effect providing primary and secondary protection, the secondary protection providing a back-up in the event that the primary protection fails. Even in the arrangement disclosed in European Patent Specification No. EP-A No. 0202939 (Otter Controls Ltd), which utilizes two partially overlapped bimetallic blades which nest with a generally complementarily shaped double-dimple formation specially provided in the element head, the potential exists for problems to arise as regards locating the bimetals relative to the element head and in good thermal contact therewith when consideration is given to the relatively imprecise manufacturing tolerances of electric heating elements.

Another proposal for the provision of both primary and secondary or back-up protection is disclosed in British Patent Specification No. GB-A No. 2181598 (Strix Ltd). According to this proposal, a bimetal held in contact with the element head controls the operation of a primary pair of switching contacts in a conventional manner, and a contact of a secondary pair of switching contacts is supported by a fusible peg so that, in the event of failure of the bimetal so that the element continues to heat up, the fusible peg gives way and allows the secondary contacts to open. This proposal also suffers from the aforementioned disadvantages, and has the further disadvantage that the fusible peg may be prone to thermally induced creepage which, over a period of time, could lead to arcing between the secondary contacts and corresponding deterioration of the control. Other disadvantages arise in that fusing together of the contacts, for example on account of arcing, could totally disable the secondary protection afforded by the control in an unsafe condition.

Other prior art publications of interest are GB-A Nos. 1408387, 2133630, 2149217, EP-A No. 0014102, U.S. Pat. Nos. 4,433,231 and 4,295,114.

SUMMARY OF THE INVENTION

In accordance with one aspect of the present invention and contrary to the teachings of above-mentioned British Patent GB-A No. 1401954, the bimetallic switch-actuating element is mounted so as, in its cold condition, to present its convex side towards the element head, and so as to be spring biased for contact with the element head. The bimetal can, for example, be mounted in or on a carrier which is spring biassed towards the element head.

As opposed to the provision of a projection from the element head surface as proposed in British Patent GB-A No. 1401954, the present invention contemplates the possibility of having a substantially flat element head surface or even of providing a depression in the surface of the element head shaped to accommodate and, at least to an extent, conform to and nest with the dished shape of the bimetallic element when in its cold condition. By virtue of such arrangements, and particularly with a depression formed by stamping the element head, for example, so that a corresponding projection will appear on the element side of the element head, the element head can be contacted by the hot return part of the element proper with a relatively small contact area requiring only a small amount of silver solder for ensuring thermal transfer between the element and the head and ensuring that the heat conduction path from the contact area to the periphery of the element head and, in use, to adjacent plastic parts, is as long as possible.

By virtue of the spring biassing of the bimetallic element into contact with the element head, it is ensured that effective thermal contact between the bimetallic element and the head is obtained irrespective of variations in the dimensions of the head arising from the customary relatively coarse manufacturing tolerances of electric heating elements, and furthermore the spring biassing can be such as to flatten the dished bimetal in its cold condition against a flat element head, thereby avoiding the need for special formations on the element head.

The bimetallic switch-actuating element can, for example, be of the conventional Otter type which comprises a stressed sheet of bimetallic material having a tongue released therefrom between two outer legs, the tongue being connected to the bimetallic sheet at one end and being free of the sheet at its other end, and the outer legs being bridged adjacent the free end of the tongue. The shape of the bimetallic sheet can be varied to provide different switch operating characteristics to suit different applications and can be generally rectangular, oval, pear-shaped, circular, etc.

Such a bimetallic switch-actuating element of the conventional Otter type as above described can be mounted in the thermal control unit and arranged to actuate its associated switch contacts in any of a number of different ways, as is well known. In one possible arrangement, the bimetallic blade is mounted by its bridge portion and the movement of the tongue as the blade snaps between its oppositely dished configurations serves as the contacts operating movement of the control unit with an electrically insulating push-rod transferring the movements of the tongue to the switch contacts. Alternatively, the bimetallic blade can be mounted by the free end of its tongue and contacts operating movement can be derived from the bridge portion of the blade or any other part of the blade which performs the requisite degree of movement. Any of the known mounting arrangements can be adapted to the present invention.

According to one possibility of utilizing such a bimetallic switch-actuatng element, a cranked center leg or tongue on the bimetallic element may be utilized to provide sufficient room within the confines of the control unit for a spring loading fixing means to be applied between the center leg and a contacts-operating push-rod of the unit. According to another possibility, the center leg of the blade may be welded or otherwise secured onto an L-shaped piece of stainless steel, for example, which advantageously can extend past the free end of the center leg and abut on the back of the bridge portion of the bimetallic blade so as to "level" the center leg of the blade, and the other end of the L-shaped piece may be mounted on the contacts-operating push-rod of the control unit, preferably in a manner to permit the bimetal to pivot so as to be able to adopt the best contact position with the element head without undue physical constraint.

In an exemplary control unit according to the present invention which is briefly described hereinafter and which utilizes such a bimetallic switchactuating element of the aforementioned Otter type, the side of the bimetallic blade which faces away from the element head is mounted by its outer legs onto a yoke which has an electrically insulating upper portion providing a reference level for the fixed contact of the switching contacts set of the control unit, such fixed contact being mounted on a leaf-spring which presses against the upper portion of the yoke with a light spring pressure for urging the bimetallic blade gently into contact with the element head. The moving contact of the switching contacts set is mounted on a second leaf-spring and biassed into engagement with the fixed contact, and switch-operating movement is derived from the tongue or center leg of the bimetallic blade via a push-rod acting on the second leaf spring. By virtue of this arrangement, the relationship between the contacts position and the yoke is constant and the contacts respond to differential movement between the push-rod and the yoke. If the element head becomes bowed, then the contacts will take up a slightly different position within the switch unit, but the switching operation of the contacts and the gap between the contacts when they are in their open condition will remain constant. This is an important advantage since it is difficult to avoid a degree of distortion of the element head portions of immersion heating elements in their manufacture.

The exemplary control unit mentioned above can be used with two bimetallic elements providing primary and secondary protection, as described in British Patent Specification No. GB-B No. 2117568, and aforementioned and either with or without latching means associated with one or both of the blades, as may be desired, and secondary protection can also be achieved in accordance with the teachings of a second aspect of the present invention by arranging for the above-mentioned yoke to be deformable under over-temperature, thus allowing the "fixed" contact to move away from the "movable" contact and achieve permanent disconnection of the heating element.

According to second aspect of the present invention, therefore a thermally sensitive control comprises a bimetallic element mounted in or on a collapsible carrier, and wherein the action of the bimetal is arranged to provide a primary control function and the thermally-induced collapse of the carrier is arranged to provide a secondary or back-up control function.

The bimetallic element of such a control need not be of the conventional Otter type, but can be of any suitable type, though bimetals of a snap-acting type as opposed to creep type bimetals are preferred for switching functions. Indeed, the Otter type bimetallic blade of the exemplary control unit could be replaced by various alternative forms of bimetallic element.

In a second more preferred arrangement which is in accordance with the abovementioned second aspect of the present invention and will be described in more detail hereinafter, a plain dished bimetallic blade (i.e., without any U-shaped cut-out defining a tongue) is utilized. The blade is supported at its edges in a plastic carrier, and a push-rod is provided for transmitting the movements of the center of the blade as it switches between oppositely dished configurations into contacts-opening movement of the switch. The carrier is in turn supported so as, in use with an electric heating element, to be lightly spring biassed into contact with the heating element head. The bimetallic blade is mounted in its carrier so as, in its cold condition, to present its convex surface to the element head, with resultant advantages as aforementioned. The carrier furthermore is adapted to deform in the event that the arrangement is subjected to an excessive overtemperature at the element head with consequential permanent opening of the electric circuit of the arrangement.

As will be better appreciated from a consideration of a specific description given hereinafter of the abovementioned second arrangement and of a further, third embodiment, significant advantages reside in the concept of providing a bimetal in a collapsible carrier with the bimetal itself providing primary protection against overheating of an associated electric heating element, for example, by operation of a first set of switching contacts, and the carrier being arranged to provide secondary protection by collapsing in the event that the sensed overtemperature reaches a predetermined excessively high level, the collapse of the carrier serving to operate a second set of switching contacts which optionally and advantageously can be arranged so as never to open in the normal, primary protection mode of the device, whereby, in normal operation the second contact set will be maintained in pristine condition. The carrier and its associated bimetal can be manufactured as a sub-assembly which can readily be replaced in order to repair or refurbish a control without necessitating replacement of the entire control, and, as will be appreciated from the more detailed discussions hereinafter, such a sub-assembly lends itself to fully automatic manufacture with attendant advantages as to quality control and cost.

The bimetal carrier in the abovementioned second embodiment is arranged to be spring biased within the control device chassis by means of a first leaf-spring conductor or the like, arranged to be operated by the bimetal, the said conductor being cantilevered from the chassis and bearing at its free end upon the carrier for biassing the bimetal forwardly into contact with the member whose temperature is to be sensed. The first leaf-spring conductor can co-operate at its free end with a bridging conductor provided on the carrier, a pair of switching contacts constituting the primary contacts of the arrangement being provided at the respective co-operating parts of the leaf-spring conductor and the bridging conductor. A second leaf-spring conductor can likewise be cantilevered from the chassis and arranged to co-operate at its free end with the briding conductor through a second pair of switching contacts. In normal operation (i.e.) in the absence of any sensed overtemperature) the spring forces of the first and second leaf-spring conductors act upon the carrier so as to bias the carrier and the carried bimetal into contact with the member whose temperature is to be sensed. When the first leaf-spring is moved out of engagement with the carrier upon the bimetal responding to a sensed overtemperature condition, thereby operating the primary switching contacts, the second leaf-spring conductor will continue to bias the carrier forwardly. In the event of failure of the primary protection to operate the first leaf-spring conductor in an overtemperature condition, the temperature will continue to rise until the carrier begins to melt and is bodily moved forwardly, initially under the action of both the first and the second leaf-spring conductors until the second leaf-spring conductor meets a stop which prevents its further movement, whereupon the continued forwardly movement of the carrier will break the secondary contacts. By means of such an arrangement, the primary and secondary protection is advantageously effected all in one and the same side (the line side) of the appliance power supply, with the neutral side maintained intact, and the secondary contacts will be called upon to operate only in the unlikely event of primary failure, and thus are maintained in good condition. Rather than relying upon the spring forces of the leaf-spring conductors to bias the carrier forwardly, separate spring biassing means may be provided in the chassis.

In a third embodiment of the present invention, a bimetal in the form of a dished rectangular blade is formed with a central cruciform or X-shaped cut-out having limbs directed generally from a central aperture in the blade towards its four corners. Such a blade is a hybrid between a plain dished rectangular blade having no cut-outs, such a plain blade maximizing the force output capability of the blade but with minimal blade switching movement, and a conventional Otter type of blade having a U-shaped cut-out where the blade switching movement is significantly increased but with a corresponding reduction in the force output capability of the blade. The proposed new hybrid blade is capable of achieving substantial force output with reasonable blade switching movement, and enables the force and movement requirements of a thermal control unit to be more readily accommodated.

Advantageous features of the third embodiment reside particularly in the fact that secondary or back-up mode switching is effected in both the line and neutral poles of the AC supply to the control and, via the control, to its associated heating element. The abovementioned hybrid bimetallic blade is mounted on a thermally collapsible carrier as a sub-assembly, with a push-rod engaged at one end with the central aperture part of the blade cut-out and extending through a guide channel in the carrier for operating the "moving" contact of a switching contact set provided in the control. The control comprises first and second housing parts which assemble together in a convenient and easy clip fit manner and trap therebetween three leaf spring parts, namely, a line connecting spring which carries the "fixed" contact of the abovementioned switching contacts set and which is arranged to make electrical contact with one of the heating element cold tails when the control is assembled with an electrical heating element, a line leaf spring which has a first part carrying the "moving" contact of the switching contacts set and a second part arranged to provide a spring force biassing the carrier towards the element head and at the same time making forceful engagement with a line terminal pin of the control, and a neutral leaf spring which has a part for engaging the other cold tail of the heating element and another part which acts in similar fashion to the second part of the line leaf spring but connects with the neutral terminal pin of the control. In operation of the control, the bimetallic blade operates under normal overtemperature conditions to open the switching contacts by moving the push-rod so as to move the "moving" contact carrying part of the line leaf spring away from the "fixed" contact carried by the line connecting spring, and under abnormal and excessive overtemperature conditions the carrier will collapse towards the element head under the action of the forces developed on the carrier by the line and neutral leaf springs, and the collapsing movement of the carrier will move the line and neutral leaf springs out of engagement with the line and neutral terminal pins, thereby disconnecting both poles of the control from the AC supply.

As will be appreciated from consideration of the detailed description given hereinafter of the abovementioned third embodiment, the constructional arrangement of the third embodiment is particularly cost-effective.

Further advantageous features of the present invention are described hereinafter and are set forth with particularly in the appended claims.

BRIEF DESCRIPTION OF THE DRAWINGS

The invention together with further features and advantages thereof will best be appreciated from consideration of the following more detailed description of exemplary embodiments which are illustrated in the accompanying drawings, wherein.

DESCRIPTION OF PREFERRED EMBODIMENTS

Figure 1:
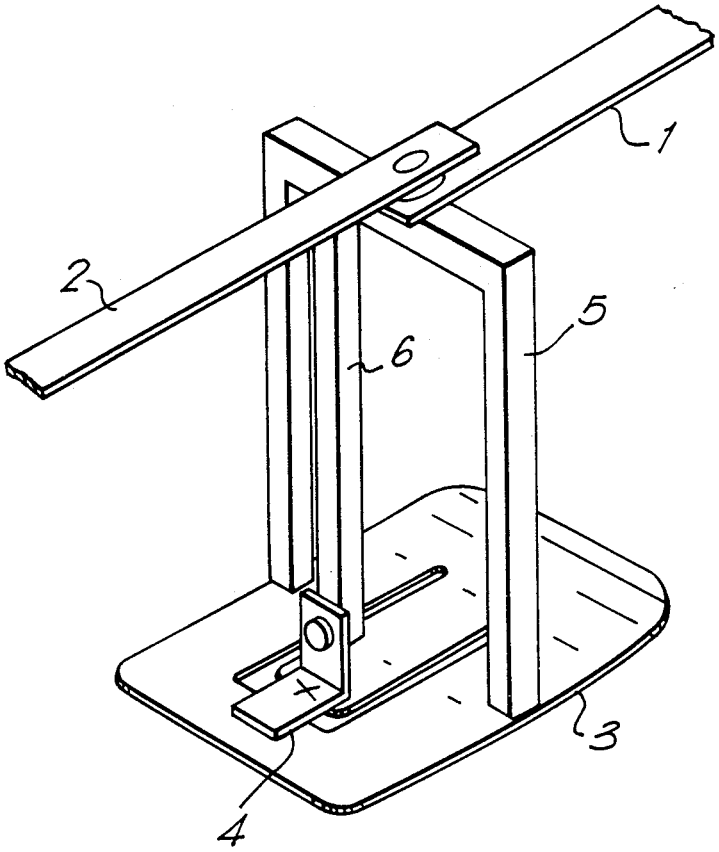
FIG. 1 is a highly schematic perspective showing of a first embodiment of the present invention.

Referring to FIG. 1 which is a schematic and incomplete showing of a first exemplary embodiment of the present invention, the parts referenced 1 and 2 represent contact-carrying leaf-springs both biassed downwardly as viewed in the drawing, the part referenced 3 represents a bimetallic switch-actuating element in the form of a dished rectangular bimetal blade having a generally U-shaped cut-out defining a central tongue intermediate two outer legs which are bridged at their ends adjacent the free end or tip (as opposed to root) of the tongue, the part referenced 4 represents an angled piece of stainless steel for example welded or otherwise secured to the tip of the tongue portion of the bimetallic blade and having a part abutting against the bridge portion of the blade so as to give the blade a more consistent attitude when in its cold condition, the part referenced 5 represents a yoke formed of plastic material for example standing with its feet on the outer leg portions of the bimetallic blade and with its upper part contacted and biassed downwardly by the action of the leaf-springs 1 and 2 when the switch contacts are closed and by the action of leaf-spring 1 when the contacts are open, and the part referenced 6 represents an electrically insulating push-rod affixed to the stainless steel piece 4 in such a manner that freedom of movement in an angular sense exists without linear "slop" the push-rod 6 bearing with its upper end against leaf-spring 2 for effecting contacts-opening movement of leaf-spring 2 when the bimetallic blade 3 snaps to its opposite configuration with rising temperature.

When, in use of the schematically illustrated unit with the underside of the bimetal 3 as viewed in FIG. 1 contacing the rear surface of the element head of the electrically powered heating element of a water boiling vessel, the bimetal blade 3 is heated by thermal contact with the hot element head and reverses its curvature from having its convex side towards the element head to having its concave side towards the element head, the consequent relative movement between the center and side legs of the blade 3 is transmitted by the push-rod 6 and the yoke 5 to the contact-carrying leaf springs 1 and 2 so as to open the contacts. By virtue of the push-rod and yoke arrangement, the blade 3 is enabled to "float" positionally to allow it to accommodate variations in the form of the element head.

As already mentioned, a secondary temperature responsive element and associated contacts could be provided for providing secondary protection in the event of the primary protection failing to operate, or alternatively, in the arrangement illustrated, the yoke 5 could be made of a material having a defined melting point so as to permit the leaf-spring 1 to move away from leaf-spring 2 and open the switch contacts in the event of the temperature reaching an excessively high level. A similar effect could be obtained by supporting the leaf-spring 1 on a second snap-acting bimetallic element having an appropriate operating temperature.

Figure 2A:
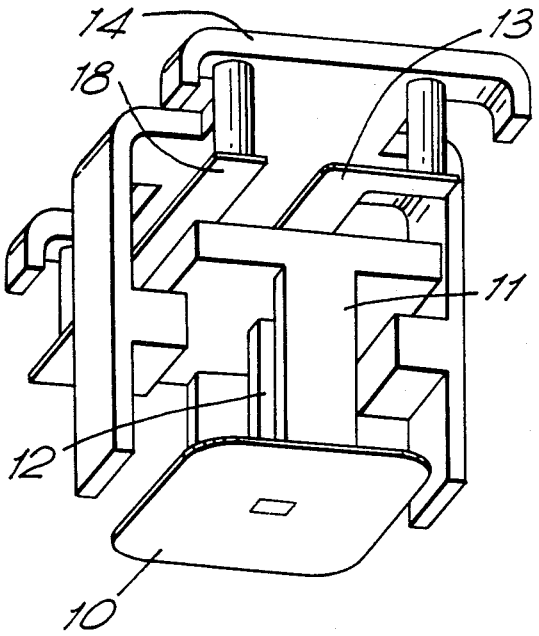
FIGS. 2A and 2B are schematic perspective views from different positions of a second embodiment of the invention.
Figure 2B:
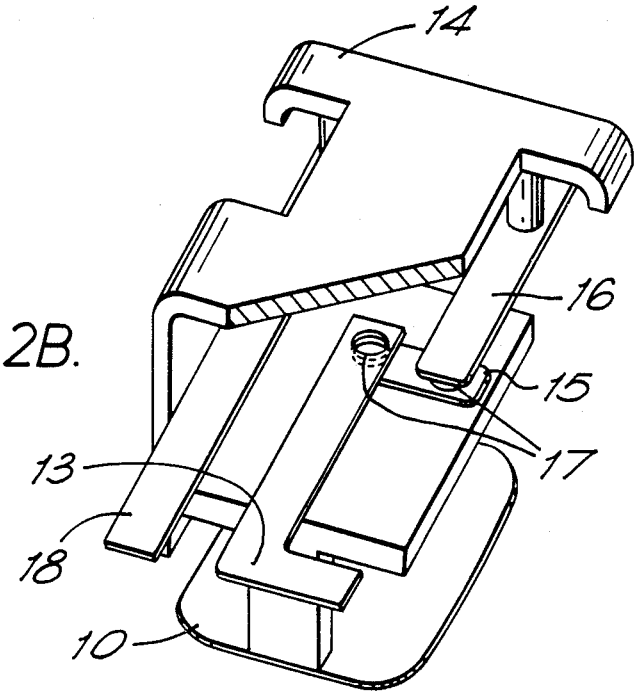

Referring now to FIGS. 2A and 2B, a second and more preferred though still schematic embodiment of the present invention is shown therein, viewed from two different directions. A bimetal blade 10 comprised by a plain dished rectangular bimetal is supported on a molded plastic carrier 11 with a push-rod 12 affixed at one end to the center of the blade 10 and extending through an aperture formed in the base of the carrier 11. The carrier 11 in essence defines a U-shaped yoke with a pair of limbs extending from the base of the carrier and abutting the blade 10 at spaced apart locations at opposite side edges thereof. A system of electrical conductors is provided behind the base of the carrier 11, a first cantilevered leaf-spring conductor 13 being secured at one end to a chassis 14 and co-operating at its other end with a second, bridging conductor 15 secured to the rear side of the base of carrier 11, and the second, bridging conductor 15 furthermore cooperating with a third cantilevered leaf-spring conductor 16 which is also secured at one end to the chassis 14. The co-operating portions of the conductors 13, 15 and 16 are provided with respective switch contacts 17. The push-rod 12 affixed to the bimetal blade 10 acts upon the first conductor 13 so that, when the bimetal reverses its curvature, the resulting relative movement between the push-rod 12 and the carrier 11 causes the first conductor 13 to break contact with the second conductor 15 and thereby open the circuit between conductors 13 and 16.

In use of the thus described arrangement of FIGS. 2A and 2B, the chassis 14 is mounted behind the element head plate of an electric heating element with the bimetal 10 lightly spring biassed into contact with a complementary dimple formed in the element head plate, by virtue of the spring forces of leaf-spring conductors 13 and 16 acting upon bridging conductor 15 secured to carrier 11. A stop (not shown) co-operates with the first leaf-spring conductor 13 to limit its permissible extent of forward movement towards the element head plate. In normal operation of the arrangement thus described, the reversal of the curvature of bimetal blade 10 in response to a sensed element overtemperature condition will cause push-rod 12 to open contact between the conductors 13 and 15. If, for whatever reason, the overtemperature condition persists and greatly excessive heat is developed in the element head, such as to cause the plastic carrier 11 to melt and collapse (in fact the side limbs of the carrier which support the bimetal blade 10 would melt first so as to cause the base of the carrier 11 to move towards the element head under the action of leafspring conductors 13 and 16), then the movement of the carrier 11 would move the bridging conductor 15 out of contact with the first conductor 13, which is restrained in its carrier-following movement by the aforementioned stop, and thereby open the circuit. The carrier 11 will of course be manufactured from such a material as to permit the collapse of the carrier to occur at a predetermined temperature and in a controlled manner, and, if desired, a separate biassing spring could be provided in the chassis for biassing the carrier forwardly towards the rear of the element head.

Electrical power to the element cold tails of an electric heating element might be controlled with the arrangement shown in FIGS. 2A and 2B with the line side of the supply being coupled through switching conductors 13, 15 and 16 and with the neutral side of the supply being coupled through a fourth, linking conductor 18. Alternatively, if desired, additional conductors could be provided for switching the neutral side of the supply in similar manner to the way the line side of the supply is switched by conductors 13, 15 and 16. With such a dual-switching arrangement, the push-rod 12 would be arranged to operate both the conductor 13 and its corresponding conductor in the neutral side of the supply.

The arrangement of FIGS. 2A and 2B provides the aforementioned advantages that, by virtue of having the dished bimetal presented to the element head plate in an orientation which is convex towards the head plate when the bimetal is cold, the complementary dimple required for nesting the bimetal with the element head plate is convex towards the element proper, so that smaller amounts of brazing or soldering alloy are required; this reduces cost and gives a lower thermal capacity leading to more rapid response to overheating. By the same token, a larger area of contact is more readily maintained between the bimetal and the complementary dimple in the element head which leads to faster heat transfer, leading to faster response times or the potential use of smaller components. As will be who are appreciated by those who are skilled in this art, faster response times provide the benefits of reduced probability of damage to the control or the associated appliance, and better segregation or differentiation between the primary form of protector actuation (the bimetal) and the secondary protector actuation (the collapse of the carrier).

The arrangement of the conductors which is illustrated in FIGS. 2A and 2B is furthermore advantageous in that is allows all circuit disconnections to take place in the line side of the control, which eliminates any possibility of either the heating element or the appliance becoming live as a result of the element overheating. Another significant advantage is that the pair of contacts which provide secondary protection (namely, the co-operating contacts of conductors 13 and 15) are not required to carry out any other function, and thus remain in perfect condition until such a time as they are required to operate.

The carrier 11 with its associated bimetal 10, push-rod 12 and conductor 15 constitutes a sub-assembly which "floats" within the chassis 14 and can be readily replaced, for the purpose of repairing or refurbishing a damaged control or a control which has been tested to destruction, without need to replace other parts of the control which can be reclaimed and reused. The said sub-assembly can readily be automatically assembled, with the bimetal, for example, being hot staked to the push-rod and being aligned by use of a non-circular hole in the bimetal receiving a non-circular section push-rod received in turn in a non-circular aperture in the carrier base.

Figure 3A:
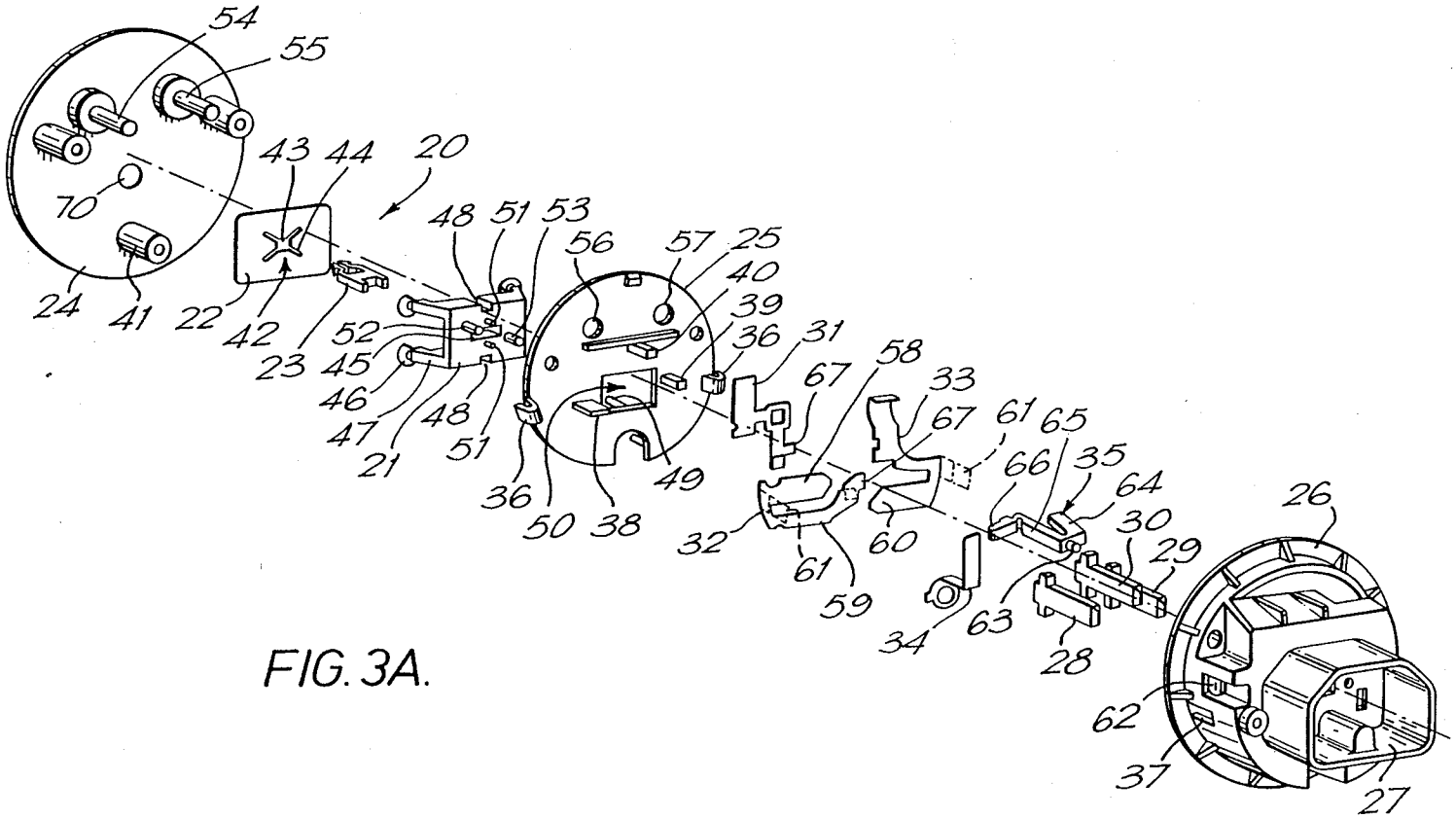
FIGS. 3A, 3B and 3C are, respectively, an exploded view of a third embodiment of the invention, and schematic plan views showing the third embodiment in normal condition and in a condition following collapse of the bimetal carrier under a severe overtemperature condition.
Figure 3B:
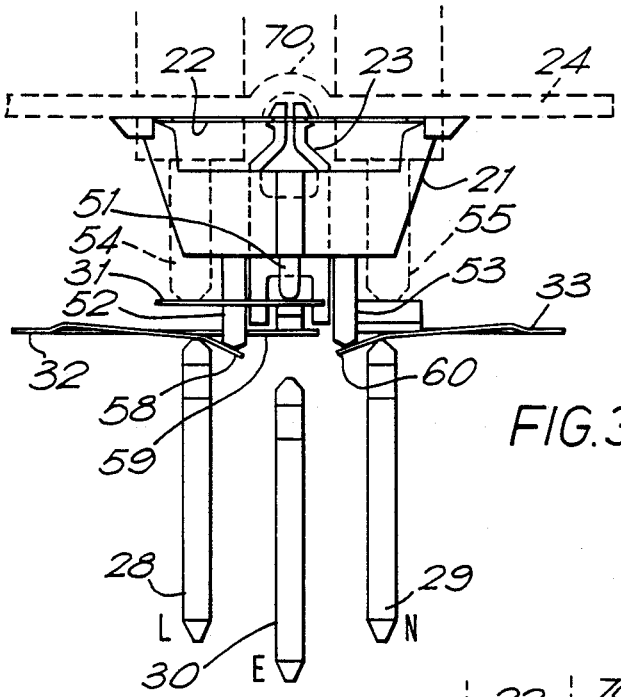
Figure 3C:
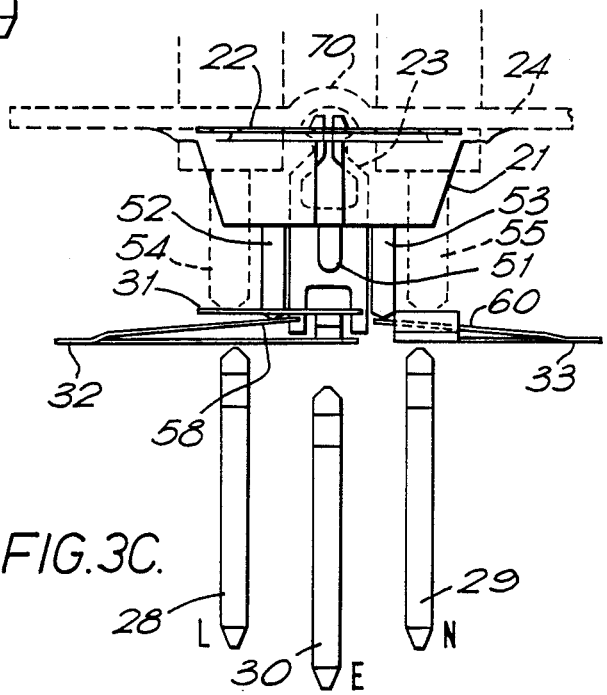

FIGS. 3A, 3B and 3C, show a third exemplary embodiment of the present invention which follows the teachings of the invention in an efficient and cost-effective manner. Referring to FIG. 3A, which is an exploded view showing the embodiment and illustrating the rear side of an element head, the control as shown comprises a sub-assembly 20 comprising a collapsible carrier 21, a bimetal blade 22 and a push-rod 23, which, as will be described more fully below, is adapted to locate in use between the rear face of the heating element head 24 and the outer side of an inner molding 25, the terms outer and inner relating to the normal positions of the respective parts in the assembled control. The inner molding 25 is adapted to co-operate with a main molding 26 defining a socket inlet 27 for a kettle connector plug, such co-operation defining within the assembled control a chamber for accommodating the L, N and E terminal pins 28, 29 and 30 of the control and for accommodating a contact-carrying line (L) connecting spring 31 a contact-carrying line leaf spring 32, a neutral (N) spring 33, an earth (E) connecting spring 34, and a latching mechanism 35. The overall control will thus be seen to comprise only relatively few parts despite its relatively complex function.

The inner molding 25 is adapted to be clipped to the main molding 26 and has a pair of integrally-formed molded spring clips 36 which co-operate with a correspondingly-located pair of apertures 37, only one of which qan be seen in FIG. 3A, so that the inner molding 25 makes a positive fit into the mouth of the main molding 26 and is positively retained therein by the clips 36. Upstands 38, 39 and 40 formed on the inner face of inner molding 5 bear against the "sword handle" parts of respective ones of the L, N and E terminal pins 28, 29, 30 when the terminal pins are inserted through their accommodating apertures in the socket inlet part 27 of the main molding and when the inner molding 25 is assembled with the main molding 26, and thus serve to retain the terminal pins securely in the assembled control. The line connecting spring 31, the line leaf spring 32 and the neutral spring 33 are also arranged to be trapped between the inner molding 25 and the main moulding 26 when the two are assembled together, thereby to retain these spring parts in their operative positions within the assembled control; this arrangement will be explained more fully below. The earth connecting spring 34 is adapted to be fixed to the upstand 41 provided on the element head 24 and to bear against the end of the earth terminal pin 30 when the control is fully assembled.

Referring now more particularly to the sub-assembly 20 comprised of the bimetallic blade 22, the push-rod 23 and the collapsible carrier 21, the bimetallic blade 22 is, as shown, of generally rectangular external configuration and is formed in its center with a cut-out which may be described as star-shaped or X-shaped or generally cruciform. The cut-out 42 has a central part 43 in the form of a generally rectangular aperture, which is oriented with its edges paralleling the edges of the blade, and also has four limbs 44 radiating from the corners of the rectangular central part generally towards the outer corners of the bimetallic blade. The blade 22 is dished so as to be capable of moving with a snap action between two oppositely dished configurations, such snap-acting dished bimetal configurations being generally well known in the art, and by virtue of the provision of the star-shaped cut-out 42 a substantially greater movement is achieved at the periphery of the central part 43 of the cut-out than would be obtained with a similar blade without any cut-out or merely with a central fixing aperture, as in the bimetallic blade 10 of the embodiment hereinbefore described with reference to FIGS. 2A and 2B.

The bimetallic blade 22 is retained in the subassembly 20 by means of the engagement of the push-rod 23 both with the bimetallic blade 22 and with the collapsible carrier 21. As can be seen most clearly in FIGS. 3B and 3C, the push-rod 23 is generally A-shaped with the apex of the A-shape, divided to form a pair of spring fingers which are adapted to be clipped into the central part 43 of the cut-out 42 formed in the bimetallic blade 22 so as to attach the blade to the end of the push-rod. The carrier 21 has a guide passage 45 formed therein as shown, the guide passage being of generally complementary cross-sectional shape to that of the push-rod, and the push-rod is adapted to be inserted into the guide passage 45 from the side of the carrier 21 which faces the inner molding 25 so that its apex can be engaged in the central part 43 of the cut-out 42 in the bimetallic blade 22. At the extremeties of its basal ends, i.e., its ends opposite to its apex, the push-rod 23 is provided with small lugs which prevent the push-rod from passing completely through the guide passage 45 in the carrier. Once the push-rod 23 is assembled with the carrier 21 and with the bimetallic blade 22, the subassembly 20 holds itself together.

The carrier 21 is generally in the form of a four-legged table and has relatively large feet 45 provided at the ends of its four legs 47 for ensuring good thermal contact with the rear face of the heating element head 24. The bimetallic blade 22 seats at its corners on the ends of the four legs of the carrier, flush with the soles of the feet 46. A pair of locating grooves 48 are provided in the carrier 21, and the inner molding 25 is provided on its outer face with a pair of upstanding rails 49, only one of which can be seen in FIG. 3A, which engage with the grooves 48 for locating and retaining the carrier relative to the inner molding. On its upper surface, the carrer 21 has four upstanding posts arranged around the guide passage 45 and designed to project through a rectangular aperture 50 provided in the inner molding 25, there being two small posts 51 only one of which is functional at any time, the second being provided to maintain the symmetry of the carrier so that it does not have to be assembled to the inner molding in one specific orientation, and two larger posts 52 and 53.

When the control is assembled together and to the element head 24 of an electrically heated water boiling vessel, for example, the heating element cold tails 54 and 55 extend through the apertures 56 and 57 provided in the inner molding and contact the upper (as viewed in FIG. 3A) ends of the line connecting spring 31 and the neutral spring 33, respectively. The lower, contact-carrying end of the line connecting spring 31 extends across the aperture 50 of the inner molding 25 and is contacted by the uppermost one of the two small posts 51 provided on the carrier 21, such posts projecting through the aperture 50. This contact between the upper post 51 and the lower end of the line connecting spring 31 establishes the position relative to the carrier, and thus relative to the push-rod, the bimetallic blade and the element head, of the contact carried by the line connecting spring 31 which constitutes the "fixed" contact of the switching contacts set; by virtue of this arrangement, variations in the dimensions of the element head can readily be accommodated since the carrier rides upon the element head.

The line leaf spring 32 is trapped between the inner and main moldings 25 and 26 when the two are assembled together, and has a first, relatively substantial limb 58 which extends across the aperture 50 formed in the inner molding 25 and is contacted and urged away from the inner molding 25 and towards the main molding 26 by the large post 56 upstanding from the carrier 21. As shown in FIG. 2B, this causes the limb 58 of the line leaf spring 32 to be biassed into contact with the line terminal pin 28. The line leaf spring 32 also has a second, less substantial limb 59 which extends acros the aperture 50 in the inner molding 25 and carries at its free end a contact which co-operates with the contact provided on the line connecting spring 31 and constitutes the "moving" contact of the switching contacts set. The second limb 59 of the line leaf spring 32 is also arranged to be abutted by the basal end of the push-rod 23 for moving the moving contact away from the fixed contact in response to switching of the bimetallic blade 22 into its "hot" condition from its normal "cold" condition.

In similar manner, the neutral spring 33 is trapped between the moldings 25 and 26 when they are assembled together, and has a relatively substantial limb 60 which extends across the aperture 50 and is butted by the post 53 on the carrier 21 into contact with the neutral terminal pin 29, as shown in FIG. 3B.

The line leaf spring 32 and the neutral spring 33 both may have integrally formed tabs 61 arranged to project through apertures 62 formed in the main molding 26 for enabling external connections to be made to the respective springs 32 and 33, for example for enabling an indication to be given as to whether or not power is, connected to the control. It is of course, to be appreciated that with this arrangement an outer cover would be provided over the control to shield the tabs 61 from the user.

A latching member 35, which is generally of the kind described in UK Pat. No. GB-B-2128409, may if desired be provided in the control for latching the switching contacts set in contacts-open condition, following switching of the bimetal into its "hot" condition, until such time as the control is reset by release of the latch. The latching mechanism shown in FIG. 3A is exemplary only and alternative latching arrangements could be employed. The latching member 35 shown in FIG. 3A is an integral molding comprising a pin 63 which is adapted to be received in an opening 64 formed in the socket inlet part 27 of the main molding 26, first and second hingedly-connected limbs 64 and 65, and a contact-spacing member 66 hingedly-connected to the end of the limb 65. The contact-spacing member 66 is adapted to be held by the ears 67 provided on the line connecting spring 31 and the line leaf spring 32 out of the switching contacts when the springs 31 and 32 are in their contacts-closed condition, and to move under its own resilience between the switching contacts when the control changes to its contacts-open condition. With the contact-spacing member 66 introduced between the switching contacts, the contacts cannot reclose until such time as the latching member is released by the application of a force to the release pin 63.

In operation of the control of FIG. 3A, the control will normally respond to an element head overtemperature condition, caused for example by switching on the supply of power to the heating element without there being sufficient water in the associated vessel, by the bimetal 22 snapping to its oppositely dished "hot" configuration.thereby causing the "moving" contact carried by line leaf spring 32 to be pushed away from the "fixed" contact carried by line connecting spring 31 by the push-rod 23. If a latching arrangement is provided, the control will then remain in its contactsoopen condition until it is manually reset, and if there is no latching arrangement, the control will cycle between contacts-open and contacts-closed condition. In the event, however, of an abnormal overtemperature condition such as might arise if the switching contacts were to weld themselves together, or if the bimetal were to fail, a secondary protection comes into play when the temperature of the element head reaches such a level (for example, from 150° C. to 180° C.) as high enough to cause the carrier 21 to collapse towards the element head by virtue of heat distortion of its legs under pressure from the spring parts 58 and 60 of the line leaf spring and the neutral spring 32 and 33, respectively. As shown in FIGS. 3B and 3C, the collapse of the carrier 21 towards the element head 24 causes the spring parts 58 and 60 to move out of contact with the line and neutral terminal pins 28 and 29 of the control, thereby disconnecting the control and the heating element from both line and the neutral sides of the power supply but, note, without disruption of the earth connection.

By virtue of the arrangement whereby the carrier 21 is urged towards the element head 24 mainly by the reaction forces developed upon the posts 52 and 53 by the spring parts 58 and 60 backed by the forces developed at the line and neutral terminal pins 28 and 29, a relatively substantial force urging the carrier 21 towards the element head 24 can be achieved. This is advantageous in that it enables the collapse of the carrier in response to an abnormally high overtemperature condition to be made dependent upon forced thermoplastic deformation of the plastic material of the carrier, which is a more reliably quantifiable characteristic of the plastic material and is demonstrated at a lower temperature than its melting point. Thus, in application to plastic bodied water boiling vessels, a substantial differential between the operating point of the secondary protection afforded by the control and the melting temperature of the vessel body can readily be achieved by selection of an appropriate material for the carrier 2. It has been found that the RYTON R7 material supplied by Phillips Petroleum is a suitable material for the carrier.

A further advantage that stems from the relative magnitude of the forces that urge the carrier towards the element head 24 is that not only is thermal contact between the carrier and the element head and between the bimetallic blade and the element head assured, but also the need for any dishing or provision of other formations on the element head for assuring good thermal contact between the bimetallic blade and the element head is obviated, since the force with which the carrier urges the bimetallic blade against the element head will effectively flatten the blade against a flat element head. This flattening of the blade out of its normal "cold" condition curvature, where its convex side would otherwise face the element head, has little or no effect upon the switching characteristics of the blade and ensures the best possible thermal contact between the blade and the head. There is need only to provide a small dimple, shown at 70 in FIG. 3A, in the element head to accommodate the end of the push-rod 23 where it projects slightly through the blade 22. The heating element might otherwise be as illustrated in FIGS. 1A and 1B of European Patent Specification No. EP-A-0202939.

The control of FIGS. 3A, 3B and 3C is advantageous in that the collapsible carrier 21 can be sited at the hottest part of the heating element head, namely, where the hot return part of the element proper is brazed to the front of the element head, so that superior discrimination between normal and abnormal operation of the control can be achieved, thereby allowing a greater safety margin on the design of the collapsible carrier and eliminating the risk of premature failure of the collapsible carrier. As will be appreciated by those skilled in the art, the secondary protection afforded by the collapsible carrier must operate within a limited temperature range. At the low temperature end of the range, the carrier must not collapse until the temperature is above the maximum temperature that the element head might reach in normal operation of the bimetal blade and its associated switching contacts, and, at the high temperature end of the range, the carrier must collapse before a temperature is reached which is so high as to represent a hazard, particularly where the control is to be used with plastic bodied vessels. The present invention makes it easier to comply with these exacting requirements.

Furthermore, the control of FIGS. 3A, 3B and 3C is relatively simple and uncomplicated in construction, so as t be simple and inexpensive to manufacture. By the use of suitable materials, such as cupro-nickels, for the pins and springs of the control, the need for plating of the terminal pin/spring contacts or for provision of special silver contacts at these locations can be avoided, and, by arranging that the contact springs are deformed on assembly of the control, using fulcrum points molded into the housing components, the forces required from the leaf springs will be generated without need for other than flat spring components; this advantageously components which advantaeously simplifies the tooling required for manufacturing the springs.

Further advantages of the control of FIGS. 3A, 3B and 3C stem from the fact that disconnection of the control from the power supply under abnormal overtemperature conditions occurs in both the line and the neutral poles of the control, and furthermore occurs at the inner ends of the line and neutral terminal pins, thereby ensuring that there are no live parts within the control after disconnection has occurred. Furthermore, the form of the bimetallic blade 22 has advantages. The blade 22 is a hybrid between a plain rectangular or other shaped bimetal and the standard center-legged Otter blade as described in UK Patent Specifications Nos. 6500055, 657434 and 1064643, for example, and an example of which is shown in FIG. 1. The cruciform performation 42 provided in the instant blade 22 provides, in effect, two oppositely directed center legs which are shorter and more rigid than the center leg of a conventional Otter blade and serve to amplify the available movement geneated by the blade without compromising the force output of the switching blade. The form of bimetallic blade utilized in the embodiment of FIGS. 3A, 3B and 3C provides a better match between the force and movement requirements of the control, while still retaining the advantage of being suited for automatic assembly.

There have thus been described new and useful temperature control units particularly though not exclusively applicable to controlling the temperature of electric immersion heater elements, particularly, though not exclusively, for water boiling vessels.

We claim:

1. A thermally-responsive control comprising a bimetal for initiating a control action in response to a predetermined over-temperature situation, a thermally collapsible carrier for said bimetal for initiating a control action in response to an extended overtemperature condition, first means responsive to the action of the bimetal in an overtemperature situation for providing a primary control function, and second means responsive to thermally-induced collapse of the carrier in an extended overtemperature situation for providing a secondary or back-up control function.

2. A thermally-responsive control as claimed in claim 1, wherein said first means comprises a set of switching contacts and a push-rod for transmitting temperature responsive movements of the bimetal to said set of switching contacts, and wherein the bimetal, the thermally collapsible carrier and the push-rod are constructed as a sub-assembly of the control.

3. A thermally-responsive control as claimed in claim 2, wherein the bimetal is dished so as to be movable with a snap-action between two oppositely curved configurations and is arranged with the carrier so that in its cold condition its convex surface faces forwardly.

4. A thermally-responsive control as claimed in claim 2, further comprising means for spring biassing the carrier and the bimetal carried thereby forwardly of the control for contacting a surface of a member whose temperature is to be sensed with a loading derived from said spring biassing.

5. A thermally-responsive control as claimed in claim 4, wherein the bimetal is dished so as to be movable with a snap-action between two oppositely curved configurations and is arranged with the carrier so that in its cold condition its convex surface faces forwardly, and wherein the spring biasing of the carrier is such as to cause the bimetal in its cold condition to be substantially flattened, in use, against the surface of a member whose temperature is to be sensed.

6. A thermally-responsive control as claimed in claim 4, wherein said spring biasing means comprises at least one electrical current carrying spring member provided in the control.

7. A thermally-responsive control as claimed in claim 6, further comprising live and neutral terminal parts, and wherein said spring biassing means comprises live and neutral spring members provided in said control, and the carrier cooperates with said spring members so as to obtain, by virtue of said spring members, the aforesaid forward spring biasing of the carrier and additionally to obtain respective electrical contacts between said live and neutral spring members and live and neutral terminal parts of the control.

8. A thermally-responsive control as claimed in claim 7, wherein said live and neutral spring members, said live and neutral terminal parts, and said carrier are together arranged such that, in response to said carrier suffering a thermally induced collapse, the electrical contacts between said live and neutral spring members and said live and neutral terminal parts are broken.

9. A thermally-responsive control as claimed in claim 8, wherein said live and neutral spring members comprise leaf springs trapped between first and second molded plastic housing parts of the control.

10. A thermally-responsive control as claimed in claim 9, wherein said leaf springs are formed substantially flat and said molded plastic housing parts include molded fulcrums which serve to bend the leaf springs into their operative configurations for obtaining the requisite spring forces within the control.

11. A thermally-responsive control as claimed in claim 9, wherein the first and second molded plastic housing parts of the control define therebetween an enclosure containing said leaf springs, and the thermally collapsible carrier is adapted to be movably mounted with respect to one of said housing parts on the outer side thereof relative to said enclosure and has provided thereon parts which extend into said enclosure and into contact with said leaf springs.

12. A thermally-responsive control as claimed in claim 11, wherein said set of switching contacts comprises a fixed contact and a moving contact and the position of the carrier is adapted to determine the position of the fixed contact and thereby to predetermine the positional relationship between the bimetal and the switching contacts set of the control.

13. A thermally-responsive control as claimed in claim 12, wherein the fixed contact of the switching contacts set of the control is carried by a leaf spring provided within said enclosure and trapped between said first and second molded plastic housing parts, and a part of said collapsible carrier projects into said enclosure and into contact with said fixed contact carrying leaf spring for determining the position of the fixed contact.

14. A thermally-responsive control as claimed in claim 1, wherein the collapsible carrier is arranged to collapse by forced thermoplastic deformation and not by melting.

15. A thermally-responsive control as claimed in claim 1, in combination with an electric heating element comprising a head portion and an element proper mounted on said head portion with a hot return portion of the element proper affixed to one side of the head portion, the control being affixed to the head portion of the heating element with the bimetal of the control in thermal contact with that region of the element head portion which lies on the opposite side of the element head portion from the position whereat the hot return portion of the element proper is affixed to the head portion.

16. A combination as claimed in claim 15, wherein the head portion of the heating element comprises a substantially flat plate and the control comprisss spring means biasing said thermally-collapsible carrier towards said plate so that the bimetal, in its cold condition, is flattened against the element head plate by the spring biasing of the carrier.

17. A thermally-responsive control as claimed in claim 1, wherein the bimetal comprises a dished blade of bimetallic material having a generally X-shaped central cut-out.

18. An element protection control for protecting an electrically powered heating element against overheating, said control being adapted to be affixed to a head portion of the heating element and comprising a snap-acting bimetallic element, a thermally-deformable carrier for said bimetallic element, spring means biasing said carrier and said bimetallic element towards a part of the head portion of the element which in operation reflects the element temperature so that both the bimetallic element and the carrier are subjected in use of the control to the temperature of the head portion of the heating element, and a pair of switch contacts arranged to be controlled for determining the supply of electrical power to the heating element in dependence upon the condition of the bimetallic element, the bimetallic element and the said switch contacts providing primary protection for the heating element, and secondary or back-up protection which is operable in the event of failure of the primary protection being provided by virtue of the control further including a further switch means in series with said switch contacts and arranged so as to be rendered opencircuit in the event of said carrier collapsing.

19. An element protection control as claimed in claim 18, wherein the bimetallic element is mounted with said carrier as a sub-assembly together with a push-rod for operating said switch contacts, and wherein said spring means for spring biasing the carrier and the bimetallic element against the element head comprises current-conducting spring members provided in the control, said control includes current supply terminals, and said current-conducting spring members furthermore serve for making and breaking electrical connections within the control with said current supply terminals in dependence upon the condition of said collapsible carrier.

20. An element protection control as claimed in claim 19, wherein said current supply terminals comprise live and neutral terminals and said spring members are arranged so that the electrical connections to both the live and the neutral poles of the control are dependent upon the condition of said collapsible carrier, the arrangement ensuring that following collapse of said collapsible carrier no internal parts of the control will be electrically connected to the live and neutral terminals of the control.

21. An element protection control as claimed in claim 20, wherein said spring members comprise leaf springs mounted in the control, said leaf springs comprising a line connecting spring adapted to make electrical contact with a first element cold tail of the heating element when the control is assembled thereto and having a fixed contact carrying portion the position whereof relative to the element head is determined by the carrier, a line leaf spring having a first portion carrying a moving contact which co-operates with said fixed contact for determining the supply of power to the heating element in dependence upon the condition of the bimetal and a second portion adapted to be urged by said carrier into engagement with the line terminal of the control and to apply a spring biasing reaction force to the carrier, and a neutral leaf spring having a first portion adapted tomake electrical contact with a second element cold tail of the heating element when the control is assembled thereto and a second portion adapted to be urged by said carrier into engagement with the neutral terminal of the control and to apply a spring biasing reaction force to the carrier, the said second portions of the line and neutral leaf springs being arranged to move out of electrical contact with the live and neutral terminals of the control in the event of the carrier collapsing under the force of said portions due to overheating of the material of the carrier.

22. An element protection control as claimed in claim 18, wherein the bimetal comprises a dished blade of bimetallic material having a central generally S-shaped cut-out formed therein.

23. An element protection control as claimed in claim 18, in combination with a heating element as aforesaid and with the control affixed to the element head portion of the heating element, the bimetallic element being a dished element oriented so as, in its cold condition, to have its normally convex surface facing the element head, and the spring biased mounting of the bimetallic element in the control serving to flatten the bimetallic element, in its cold condition, against a flat surface of the heating element head.

24. A thermally-responsive control adapted for use with an electrical heating element comprising an element head portion, a heating element proper mounted on said element head portion, and heating element terminal portions, said control serving to determine the supply of electrical current to said heating element in an element overtemperature condition and said control comprising: current supply terminals for connection of the control to an electrical supply and for supplying electrical current to the heating element via the control in normal operation; means for making electrical contact between said current supply terminals and said terminal portions of the heating element, such means including at least one spring means adapted to be biased into contact with a respective one of said current supply terminals for making electrical contact between that one of said current supply terminals and a respective one of said heating element terminal portions; and biasing means for biasing said at least one spring means for making said electrical contact, said biasing means comprising a member formed of a thermally deformable material and arranged in the control to be subject to the temperature of the element head portion, such member being adapted in the event of an element overtemperature condition to deform so as to release such biasing of said at least one spring means, thereby to break the electrical contact made between the respective current supply terminal and the respective- heating element terminal portion.

25. A thermally-responsive control according to claim 24, further comprising a bimetallic element mounted in said control so as to be subjected in use of the control to the temperature of the element head portion, and a set of switch conacts operable by said bimetallic element in response to an element overtemperature condition for interrupting the current supply path through, the control to the heating element.

26. A thermally-responsive control according to claim 25, wherein said bimetallic element is mounted in said control by means of said member formed of thermally deformable material, said member being configured as a carrier for the bimetallic element and serving to present the bimetallic element forwardly of the control for contacting the element head portion of an associated heating element, and said control further comprises a push-rod operatively coupling said bimetallic element to said set of switch contacts.

27. A thermally-responsive control according to claim 26, wherein the control comprises a main body portion and a separate sub-assembly assembled therewith, and said bimetallic element, said carrier member, and said push-rod are together configured as said sub-assembly of the control.

28. A thermally responsive control according to claim 27, wherein said means for making electrical contact between said current supply terminals and said terminal portions of the heating element comprise respective leaf springs provided in the main body portion of the control, and said biasing means comprises respective formations provided on said carrier member and operative to bias said leaf springs inwardly of the control when the control is assembled with an electrical heating element as aforesaid, with the said sub-assembly between the element head portion and the main body portion of the control.

29. A thermally-responsive control according to claim 28, wherein said bimetallic element comprises a snap-acting bimetallic element having an operating temperature corresponding to a predetermined element overtemperature condition, and said member formed of thermally deformable material is formed of a material selected to deform under the action of said leaf springs at a predetermined temperature substantially above said bimetal operating temperature.

30. A thermally-responsive control according to claim 29, wherein the member formed of thermally deformable material is arranged to collapse at said predetermined temperature by forced thermoplastic deformation and not by melting.

31. A thermally-responsive control according to claim 27, wherein said carrier member has a body portion and a plurality of deformable legs each with a relatively broad foot adapted in sue of the control to stand upon the element head portion of an associated heating element so as to be in close thermal contact therewith, the bimetallic element is supported between said feet, and the push-rod extends from an intermediate portion of said bimetal through an aperture formed in the body portion of the carrier member.

32. A thermally-responsive control according to claim 31, wherein the bimetallic element comprises a dished blade of bimetallic material having generally centrally formed therein a generally X-shaped cut-out, and said push-rod is engaged at one end thereof with said cut-out.

* * * * *